US012241710B2

(12) United States Patent
Greer et al.

(10) Patent No.: US 12,241,710 B2
(45) Date of Patent: Mar. 4, 2025

(54) AUTOMATED MISSILE LOADING SYSTEM

(71) Applicant: Raytheon Company, Waltham, MA (US)

(72) Inventors: Christopher Alden Greer, Tuscon, AZ (US); Brian Gin, Vail, AZ (US); Nathan Albrand Jones, Vail, AZ (US); Zachary Boydell, Cary, NC (US); Emile M. Szlemko, Vail, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/181,540

(22) Filed: Mar. 9, 2023

(65) Prior Publication Data

US 2024/0035766 A1 Feb. 1, 2024

Related U.S. Application Data

(60) Provisional application No. 63/269,163, filed on Mar. 10, 2022.

(51) Int. Cl.
*F41A 9/09* (2006.01)
*F41A 9/87* (2006.01)

(52) U.S. Cl.
CPC . *F41A 9/09* (2013.01); *F41A 9/87* (2013.01)

(58) Field of Classification Search
CPC ..... F41A 9/09; F41A 9/10; F41A 9/11; F41A 9/13; F41A 9/14; F41A 9/16; F41A 9/20; F41A 9/21; F41A 9/22; F41A 9/87
(Continued)

(56) References Cited

U.S. PATENT DOCUMENTS 5,837,922 A 11/1998 Maher et al.
7,849,762 B2 * 12/2010 Viola ..... B66F 3/08 74/471 XY (Continued)

FOREIGN PATENT DOCUMENTS

EP 0635695 B1 11/1996
EP 0710812 B1 9/1997
KR 102326233 B1 11/2021

OTHER PUBLICATIONS

First Office Action dated Dec. 16, 2024, for corresponding United Arab Emirates Patent Application No. P6000563/202, 11 pgs.

*Primary Examiner* — Bret Hayes
(74) *Attorney, Agent, or Firm* — Kinney & Lange, P.A.

(57) ABSTRACT

Apparatus and associated methods relate to automatically loading a plurality of hazardous entities into a hazardous-entity container. Such automatic loading is performed by: i) lifting a selected hazardous entity of a plurality of hazardous entities from a stowed position to an elevation of a corresponding hazardous-entity portal of the hazardous-entity container; ii) sensing relative alignment the selected hazardous entity with respect to the corresponding hazardous-entity portal iii) aligning the selected hazardous entity with the corresponding hazardous-entity portal based on the relative alignment sensed by the alignment sensor; iv) evaluating whether an insertion condition is met based at least in part on the relative alignment sensed by the alignment sensor; and v) inserting the selected hazardous entity into its corresponding hazardous-entity portal if the insertion condition is met.

18 Claims, 4 Drawing Sheets

(58) Field of Classification Search
USPC ..... 89/45, 46
See application file for complete search history.

(56) References Cited

U.S. PATENT DOCUMENTS

| | | | | |
|---|---|---|---|---|
| 8,336,442 | B2 * | 12/2012 | Testa | F41A 9/20 89/45 |
| 2006/0162541 | A1 | 7/2006 | Heldmann et al. | |
| 2022/0041416 | A1 * | 2/2022 | Viola | B60P 9/00 |
| 2024/0077265 | A1 * | 3/2024 | Natesan | F41A 9/42 |

* cited by examiner

AUTOMATED MISSILE LOADING SYSTEM

CROSS-REFERENCE TO RELATED APPLICATION(S)

The present application claims the benefit of U.S. Provisional Patent Application Ser. No. 63/269,163, entitled "Automated Missile Loading System," by Christopher A. Greer, et al., filed Mar. 10, 2022, which is hereby incorporated in its entirety by reference.

BACKGROUND

Loading missiles into launchers is a time consuming, personnel intensive, and potentially dangerous process. As such, loading processes must be completed at centralized locations by trained and specialized individuals. The present system involves using a series of chains or lifts to raise the munitions to the launcher. Individuals are required to adjust and load the munitions onto the lifting system. After the munitions have been raised to level of the launcher, individuals manually align the munitions with the openings in the launcher and the munitions are inserted into the launcher bays. In order to maintain safety, these procedures must be carried out in highly controlled and physically stable environments.

SUMMARY

Apparatus and associated methods relate to a system for automatically loading a plurality of hazardous entities into a hazardous-entity container. the system includes an elevator configured to lift a selected hazardous entity of a plurality of hazardous entities from a stowed position to an elevation of a corresponding hazardous-entity portal of the hazardous-entity container. The system includes an alignment sensor configured to sense relative alignment of the selected hazardous entity with respect to the corresponding hazardous-entity portal. The system includes an alignment system configured to align, based on the relative alignment sensed by the alignment sensor, the selected hazardous entity with the corresponding hazardous-entity portal. The system includes an insertion apparatus configured to insert the selected hazardous entity into its corresponding hazardous-entity portal. The system also includes a loading controller configured to evaluate, based at least in part on the relative alignment sensed by the alignment sensor, whether an insertion condition is met. The loading controller if further configured to cause the insertion apparatus to insert the selected hazardous entity into the corresponding hazardous-entity portal in response to the insertion condition being met.

Some embodiments relate to a method for automatically loading a plurality of hazardous entities into a hazardous-entity container. In the method a selected hazardous entity of a plurality of hazardous entities is lifted, via an elevator, from a stowed position to an elevation of a corresponding hazardous-entity portal of the hazardous-entity container. Relative alignment of the selected hazardous entity is sensed, via an alignment sensor, with respect to the corresponding hazardous-entity portal. The selected hazardous entity is aligned with the corresponding hazardous-entity portal, via an alignment system, based on the relative alignment sensed by the alignment sensor. An insertion condition is evaluated, via a loading controller, so as to determine whether an insertion condition is met, based at least in part on the relative alignment sensed by the alignment sensor. The selected hazardous entity is inserted, via an insertion apparatus, into its corresponding hazardous-entity portal in response to the insertion condition being met.

DETAILED DESCRIPTION

Figure 1:
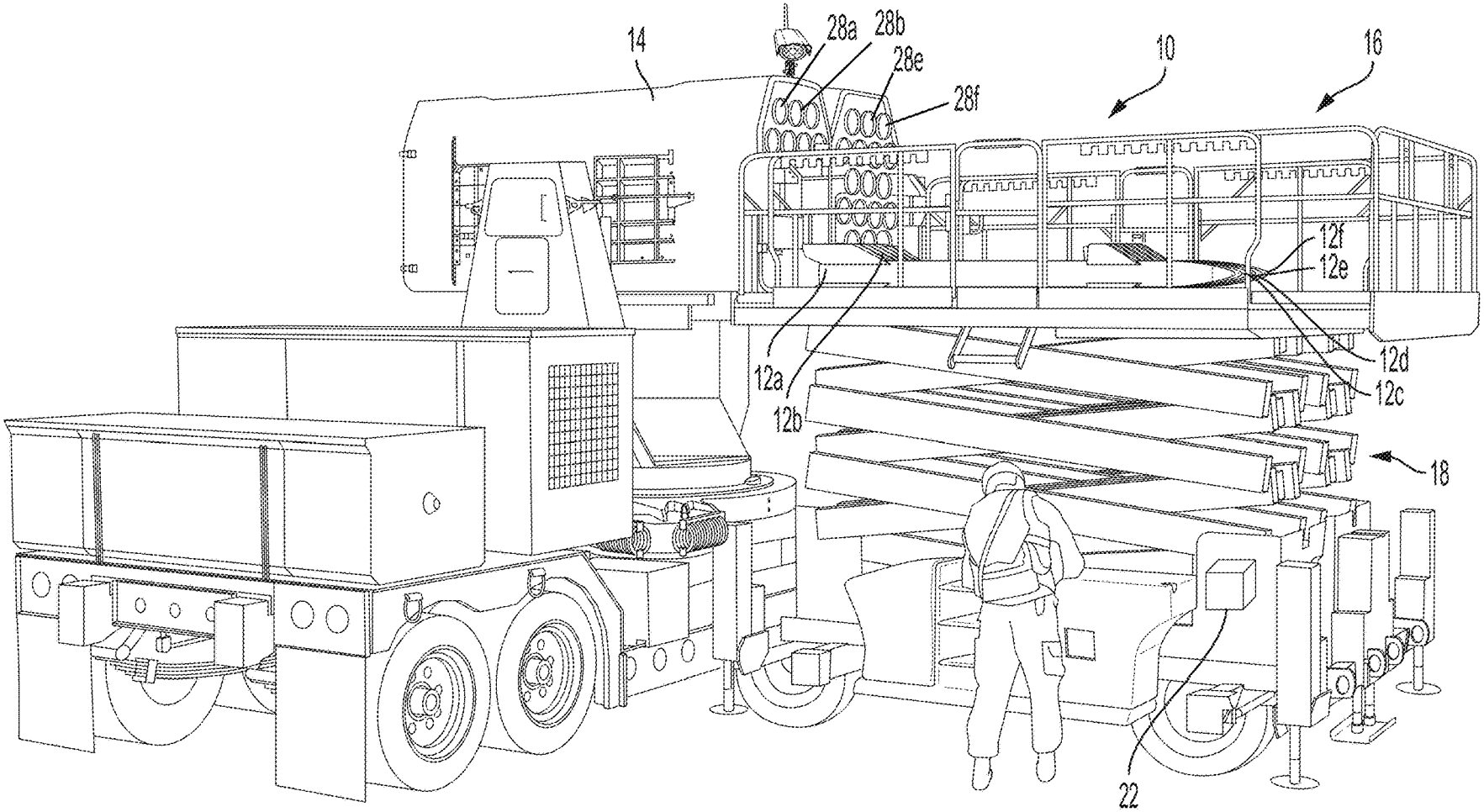
FIG. 1 is a perspective view of an automated missile loading system.

Apparatus and associated methods relate to automatically loading a plurality of hazardous entities into a hazardous-entity container. Such automatic loading is performed by: i) lifting a selected hazardous entity of a plurality of hazardous entities from a stowed position to an elevation of a corresponding hazardous-entity portal of the hazardous-entity container; ii) sensing relative alignment the selected hazardous entity with respect to the corresponding hazardous-entity portal iii) aligning the selected hazardous entity with the corresponding hazardous-entity portal based on the relative alignment sensed by the alignment sensor; iv) evaluating whether an insertion condition is met based at least in part on the relative alignment sensed by the alignment sensor; and v) inserting the selected hazardous entity into its corresponding hazardous-entity portal if the insertion condition is met.

Such automated loading of a plurality of hazardous entities into a hazardous-entity container can provide uniformity to such loading. Such automated loading of hazardous entities can be uniform in the way that that the hazardous entities are loaded, and/or in the time that such loading takes place, independent of the location where the loading takes place. Thus, a safe method of loading hazardous entities can be replicated, independent of various factors, such as personnel, location, time of day, etc. Such automated loading can be performed on a wide variety of hazardous entities, including, for example, bombs, torpedoes, artillery, fireworks, avalanche inducing explosives, explosive charges (e.g., for demolition and/or excavation) etc. The description below will describe loading of one type of such hazardous entities-missiles, but a person of ordinary skill in the art would know how to adapt such methods and apparatus described below for automating the loading of other hazardous entities.

Current methods for loading missiles require large amounts of time and manpower. In order to load missiles safely, they must be loaded by specially-trained persons and in controlled environments. This means that, on a practical level, missiles must be loaded by a team of trained individuals at a centralized location. While this system can be successfully implemented by organizations that have large numbers of people that can be dedicated to this single process, organizations with limited personnel struggle to load missiles efficiently. Furthermore, the present system limits the ability of a single missile-carrying vehicle to effectively operate away from a centralized missile loading station. Missile-carrying vehicles used in the current system must stay relatively close to missile loading areas, must limit the number of engagements they have, and/or limit the duration of their missions in order to ensure that they maintain a sufficient number of missiles for the purposes for which it has been deployed. This limits the ability of the organization to operate efficiently and effectively at remote locations.

Efforts to automate the system have been stymied by limitations regarding the ability of a system to intelligently sense deviations from the standard environmental conditions and positioning and to correct for those deviations in real time. Missiles loaded by automated systems that are not in highly controlled environments risk major issues regarding safety and consistency. The present invention uses a combination of algorithmic and mechanical means to safely load missiles into a launcher without human intervention after the system is initiated.

Figure 2:
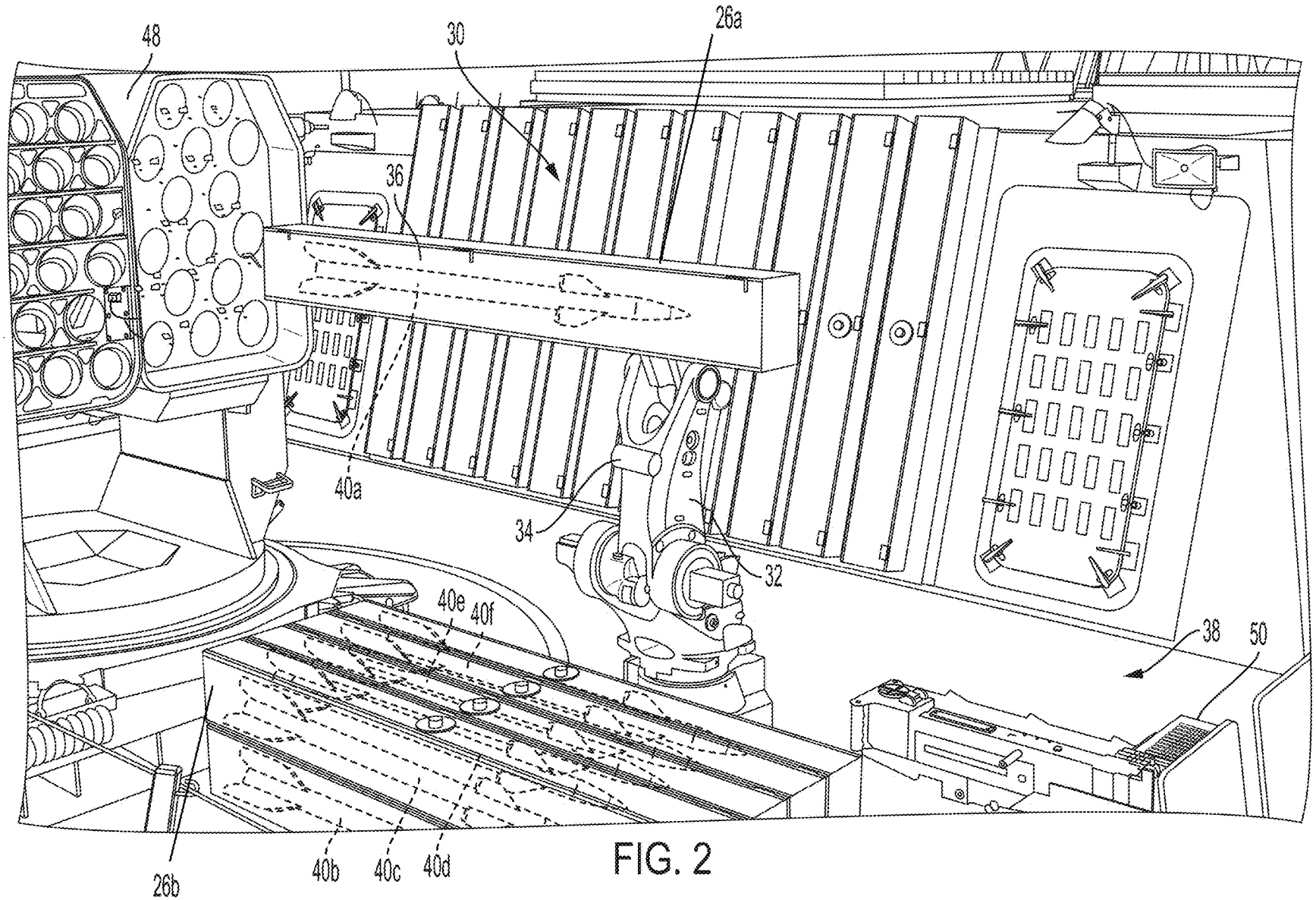
FIG. 2 is a perspective view of a robotic arm driven automated missile loading system.

FIG. 1 is a perspective view of a lift driven automated missile loading system. In FIG. 2, automated missile loading system 10 is shown loading missiles 12*a*-12*f* into missile launcher 14. Automated missile loading system includes missile holding area 16, missile elevator 18, alignment sensor 20, alignment system 22, and missile insertion apparatus 24. Missile holding area 16 stows missiles 12*a*-12*f*. In some embodiments, missile holding area stows missiles 12*a*-12*f* in corresponding stowage receivers 26*a*-26*f*, as depicted in the FIG. 1 embodiment. Missile elevator 18 lifts each of missiles 12*a*-12*f* from its corresponding stowage receiver 26*a*-26*f* to an elevation of a corresponding missile portal 28*a*-28*f* of missile launcher 14. Alignment sensor 20 senses relative alignment of missile 12*a* lifted to the elevation of its corresponding missile portal 28*a*. Alignment system 22 aligns, based on the relative alignment sensed by alignment sensor 20, missile 12*a* lifted with its corresponding missile portal 28*a*. Missile insertion apparatus 24 inserts missile 12*a* lifted and aligned into its corresponding missile portal 28*a*. In some embodiments insertion of missile 12*a* into missile portal 28*a* is conditioned on an insertion condition, as will be described below. While missile 12*a*, which has been lifted to the elevation of and aligned with its corresponding missile portal 28*a*, is being inserted into its corresponding missile portal 28*a*, alignment system 22 maintains alignment of missile 12*a* and missile elevator 18 provides support to missile 12*a*.

In the embodiment depicted in FIG. 1, missiles 12*a*-12*f* are sequentially loaded into missile launcher 14. In other embodiments, more than one of missiles 12*a*-12*f* can be concurrently loaded into missile launcher 14. In such concurrent automated missile loading systems, alignment and support of missiles being concurrently loaded are maintained. Aligning and maintaining alignment of missile 12*a* with its corresponding missile portal 28*a* includes axial alignment (e.g., yaw and pitch alignment) and rotational alignment (e.g., roll alignment). Thus, alignment system 22 includes an axial alignment subsystem and a rotational alignment subsystem. Furthermore, to determine that missile 12*a* has been axially aligned with its corresponding missile portal 28*a*, alignment sensor 20 senses relative axial alignment of missile 12*a* with its corresponding missile portal 28*a*. To determine that missile 12*a* has been rotationally aligned in a fashion that is proper to its corresponding missile portal 28*a*, alignment sensor 20 senses rotational configuration of missile 12*a* with respect to its corresponding missile portal 28*a*. In some embodiments, rotational alignment is performed by a jig or receiver in which missile 12*a* is carried during the loading process. In some embodiments, rotational alignment is ensured by locations of contact features and/or engagement fixtures of missile 12*a* that engage automated missile loading system 10 and/or missile launcher 14 during the lifting of missile 12*a* and/or while loading missile 12*a*.

In some embodiments, insertion of missile 12*a* into corresponding missile portal 28*a* is initiated in response to an insertion condition being met. In some embodiments, the insertion condition is that missile 12*a* has been lifted with its corresponding missile portal 28*a* is within a predetermined alignment threshold with respect to its corresponding missile portal 28*a*. In some embodiments, insertion begins after vibration of missile 12*a* is determined to be less than a predetermined vibration threshold. When vibration of missile 12*a* is a condition for insertion, alignment sensor 20 will include a vibration detector. The vibration detector detects vibration of missile 12*a*, so as to ensure that a missile is vibrating at a low level so that during insertion, a vibration induced striking of missile 12*a* with missile launcher 14 will not occur in a manner that is harmful to either missile 12*a* or missile launcher 14. In some embodiments, alignment sensor will also include various environment detectors that can be used during missile loading operations. For example, for a ship mounted missile launcher, accelerometers, gyroscopes, or attitude sensors can monitor the motion of the ship. In some embodiments, loading of missiles can be temporarily suspended should the motion monitored exceed a predetermined motion threshold. In other embodiments, insertion of missile 12*a* can be timed to correspond to a low-motion moment or to a specific phase of a periodic rolling motion, as monitored by the attitude sensors. In some embodiments, temperature, humidity, or other environmental metric can be measured by appropriate sensors of alignment sensor 20. Such sensed metrics can be used in combination with other sensed metrics or individually. For example, at low temperatures, the predetermined alignment threshold might be less than a predetermined alignment threshold at higher temperatures, due to considerations of temperature-induced expansion and/or contraction.

In the embodiment depicted in FIG. 1, missile elevator 18 includes a scissors mechanism that maintains axial alignment throughout the lifting of missile 12*a* from an initial elevation to a final elevation—the elevation of its corresponding missile portal 28*a*. One advantage of such a scissors mechanism is that support is provided throughout the loading operation from below. This permits missile elevator 18 to be used in places where little space exists above missile portals 28*a*-28*f*. In embodiments where sufficient space exists above missile portals 28*a*-28*f*, missile elevator 18 can lift missile 12*a* from above, such as, for example, with a chain or an overhead mechanism. In other embodiments, missile elevator 18 can include a pneumatic piston to elevate missiles 12*a*-12*f* to elevation of their corresponding missile portals 28*a*-28*f*. In some embodiments, a robotic arm is used to both lift missiles 12*a*-12*f* and to align missiles 12*a*-12*f* with their corresponding missile portals 28*a*-28*f*.

FIG. 2 is a perspective view of a robotic arm driven automated missile loading system. Automated missile loading system 30 includes robotic arm 32 which includes various components of automated alignment system 34 and automated insertion system 36. In the embodiment of FIG. 2, automated missile loading system 30 is on ship 38. Robotic arm 32 can engage (i.e., grasp or attach to) missile 40*a* and then raise missile 40*a* from starting elevation 42 to loading elevation 44 of corresponding missile portal 40*a*. Automated alignment system 34 senses the position (e.g., axial alignment, rotation, etc.) of missile 40*a* relative to missile portal 46*a* of missile launcher 48 and relays such a sensed relative position to control system 50. Control system 50 calculates, in real time, any adjustments that might be needed to the relative position of missile 40*a*. Such adjustments can be calculated based on other metrics, such as, for example, environmental factors including missile vibration, missile launcher attitude, and missile pitch, yaw, and roll, temperature, humidity, etc. Automated alignment system 34 executes such adjustments calculated by control system 50 in real time. After such adjustments have been made and a criterion for insertion has been achieved, automated insertion system 36 advances missile 40*a* into its corresponding missile portal 46*a*. Robotic arm 32 then retracts and automated missile loading system 30 repeats such a loading operation if more missiles 40*b*-40*f* are to be loaded.

In some embodiments, automated missile loading systems can be mobile. Such mobile automated missile loading system can include for example, a truck, ship, motorized dolly, motorized lift, and/or wheels. Automated loading systems which are intended for mobile or remote use can be constructed using lightweight materials, so as to not cause damage to the underlying substrate or to cause sinking or other effects that may affect the safety and operability of the system. Examples of such lightweight materials can include, for example, carbon fiber, aluminum, polymers, or other such lightweight materials.

Figure 3:
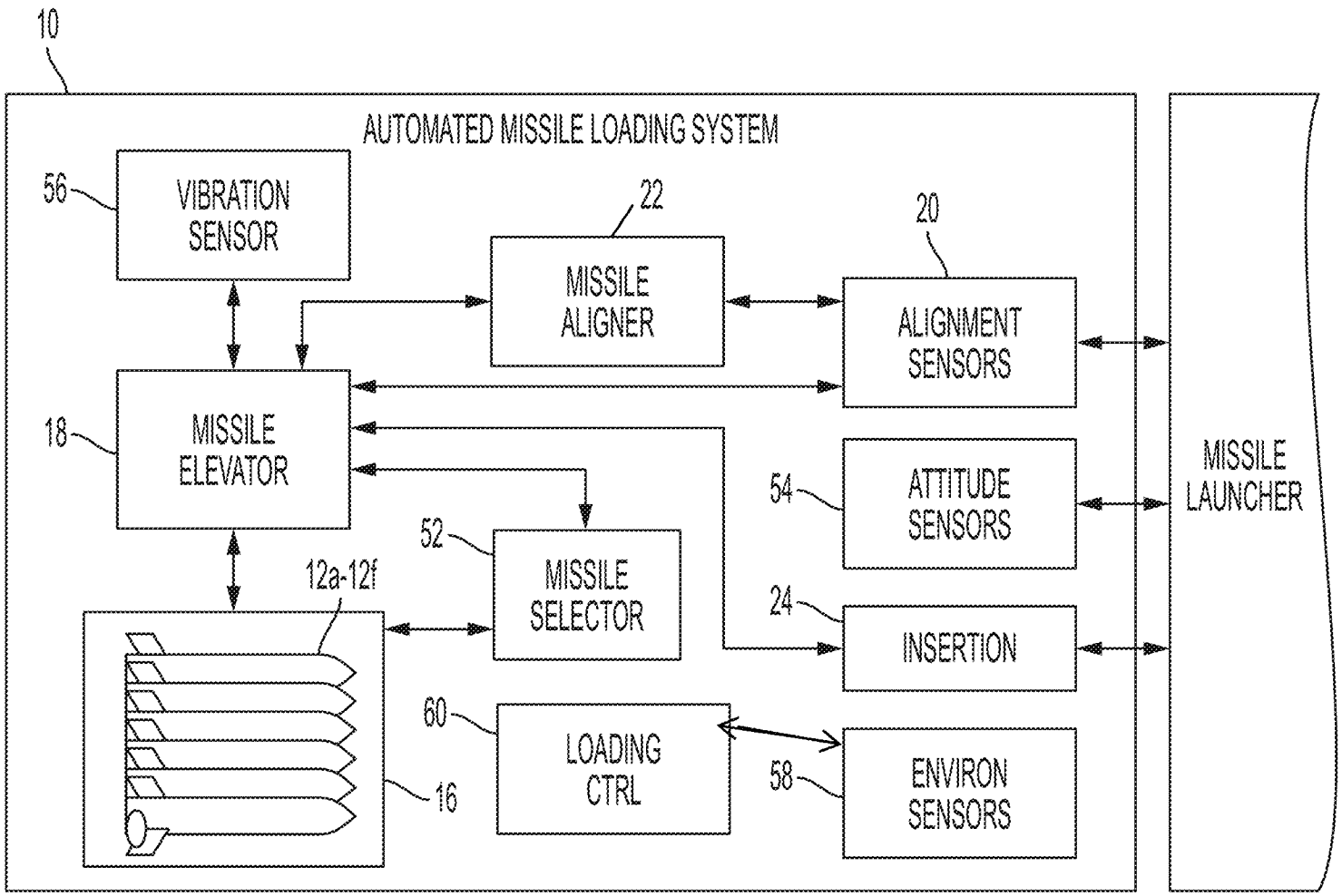
FIG. 3 is a block diagram of automated missile loading system.

FIG. 3 is a block diagram of automated missile loading system. In FIG. 3, automated missile loading system 10 includes missile holding area 16, missile selector 52, missile elevator 18, missile alignment sensors 20, missile-launcher attitude sensor 54, missile vibration sensor 56, environmental sensors 58, alignment system 22, missile insertion apparatus 24, and missile loading controller 60. Missile holding area holds missiles that are ready to be loaded into missile launcher 14 (depicted in FIG. 1). Missile selector 52 selects one or more of missiles 12*a*-12*f* (depicted in FIG. 1), which are held in the missile holding area. After selecting one or more of missiles 12*a*-12*f*, missile selector 52 transports such selected missile or missiles to missile elevator 18. Missile elevator 18 then lifts the selected missile or missiles to an elevation of a corresponding missile portal or portals 28*a*-28*f* (depicted in FIG. 1) of missile launcher 14.

Alignment sensors 20 sense relative alignment of the missile or missiles lifted with a corresponding missile portal or portals. Alignment system 22 aligns the missile or missiles lifted with a corresponding missile portal or portals. Such alignment is based on the relative alignment sensed by alignment sensor 20. Missile-launcher attitude sensor 54 senses attitude metrics of the missile launcher. Such attitude sensing can be configured to sense a dynamic attitude of a missile launcher that is part of a larger vehicle in motion, such as, for example, a ship. Attitude metrics sensed by missile-launcher attitude sensor 54 can be used in determining whether an insertion condition has been met. Missile vibration sensor 56 senses vibration of the missile or missiles lifted and aligned. Vibration metrics sensed by missile vibration sensor 56 can be used in determining whether an insertion condition has been met. Environmental sensors 58 sense environmental metrics, such as, for example, temperature and pressure. Such attitude metrics, vibration metrics, and/or environmental metrics can be used in combination with alignment metrics to calculate whether an insertion condition is met or to determine whether an interrupt condition is met. An interrupt condition can be used to interrupt insertion of the missile or missiles that is already in progress. Missile loading controller 60 can be configured to receive such metrics, calculate such insertion and/or interrupt conditions, and control the various components of automated missile loading system 10.

Missile insertion apparatus 24 inserts the missile or missiles lifted and aligned into its corresponding missile portal, in response to the insertion condition being met. While the missile or missiles lifted and aligned are being inserted into a corresponding missile portal or portals, the alignment system maintains alignment of the missile lifted to the elevation of its corresponding missile portal and the missile elevator provides support to the missile lifted to the elevation of its corresponding missile portal.

Figure 4:
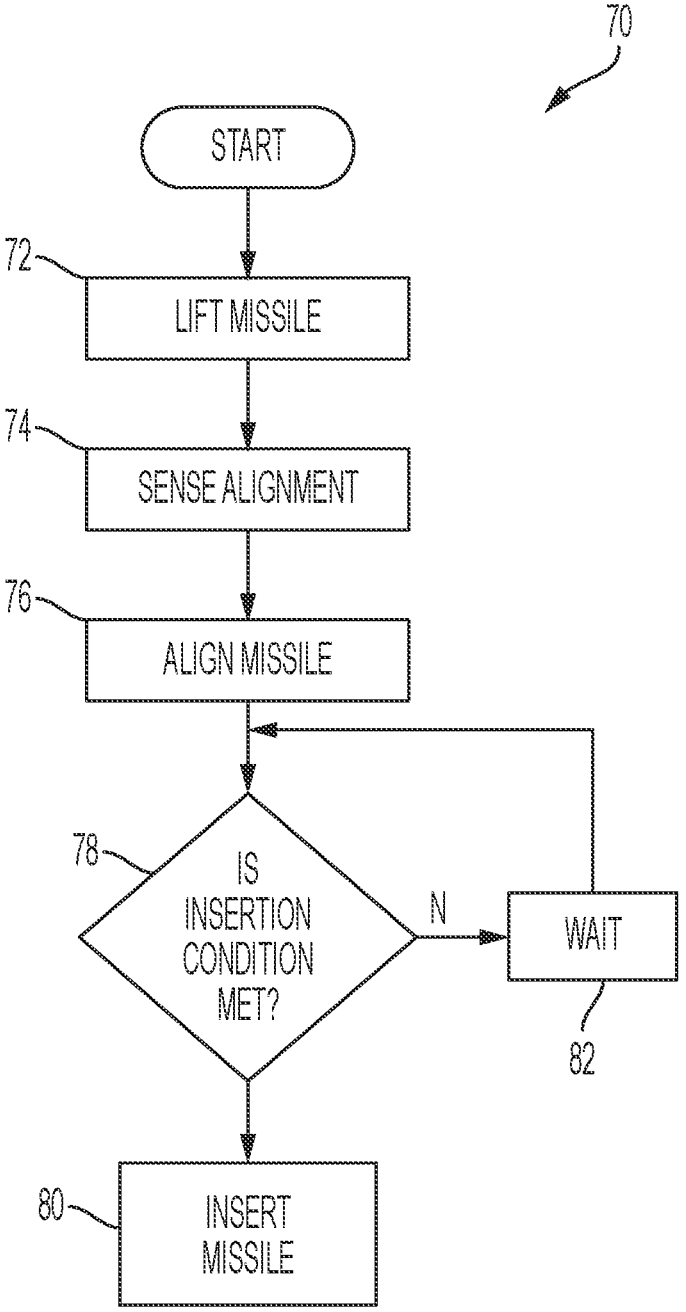
FIG. 4 is a flow chart of the method for operating an automated missile loading system.

FIG. 4 is a flow chart of the method for operating an automated missile loading system. The FIG. 4 depicted flow chart is given from the perspective of missile loading controller 60 depicted in FIG. 3. Method 70 begins at step 72, where missile loading controller 60 causes missile elevator 18 to lift a selected missile of a plurality of missiles from a stowed position to an elevation of a corresponding missile portal of the missile launcher. At step 74, missile loading controller 60 causes alignment sensor 20 to senses relative alignment of the selected missile lifted with respect to the corresponding missile portal. At step 76, missile loading controller 60 causes alignment system 22 to align the selected missile lifted with the corresponding missile portal based on the relative alignment sensed by the alignment sensor. At step 78, missile loading controller 60 evaluates whether an insertion condition has been met. The insertion condition is based, at least in part, on the relative alignment sensed by alignment sensor 20. If at step 78, missile loading controller 60 evaluates that the insertion condition has been met, then method 70 proceeds to step 80, where missile loading controller 60 causes missile insertion apparatus 24 to insert the selected missile aligned into its corresponding missile portal. If, however, at step 78, missile loading controller 60 evaluates that the insertion condition has not been met, then method 70 proceeds to step 82, where missile loading controller 60 waits for a time period. After such a time period has elapsed, method 70 returns to step 78 where missile loading controller 60 reevaluates whether the insertion condition is met.

Not only can the loading of missiles be automatically loaded into a missile launcher, but such automation can be performed for various other hazardous entities, such as for example, bombs, torpedoes, artillery, fireworks, avalanche inducing explosives, explosive charges (e.g., for demolition and/or excavation) etc. Such automatic loading of hazardous entities beneficially reduces the risk of such loadings, expands the number of venues in which such loadings can take place, makes such loadings uniform in their operation, and reduces the times for such loading operations.

A system can be configured to automatically load such hazardous entities into a hazardous-entity container. The hazardous-entity container can be configured to subsequently deploy the hazardous entities loaded therein, as was described above for missile entities or in a fashion suited for the particular hazardous entities loaded therein. In other embodiments, the hazardous-entity container can be configured to transport and/or store the hazardous entities. The automatic-loading system can include an elevator, an alignment sensor, an alignment system, an insertion apparatus, and a loading controller. The elevator can be configured to lift a selected hazardous entity of a plurality of hazardous entities from a stowed position to an elevation of a corresponding hazardous-entity portal of the hazardous-entity container. The alignment sensor can be configured to sense relative alignment of the selected hazardous entity lifted with respect to the corresponding hazardous-entity portal. For example, the alignment sensor can sense one or more of axial alignment, elevational alignment, lateral alignment, longitudinal alignment, etc. The alignment system can be configured to align, based on the relative alignment sensed by the alignment sensor, the selected hazardous entity with the corresponding hazardous-entity portal. After alignment, the insertion apparatus can be configured to insert the selected hazardous entity into its corresponding hazardous-entity portal. The loading controller can be configured to evaluate, based at least in part on the relative alignment sensed by the alignment sensor, whether an insertion condition is met. The loading controller can be configured to cause the insertion apparatus to insert the selected hazardous entity into the corresponding hazardous-entity portal, in response to the insertion condition being met. Conversely, the loading controller can be configured to wait for a time period in response to the insertion condition not being met. Then, after the time period has elapsed, the loading controller can reevaluate whether the insertion condition is met. All of the operations described above, with respect to automatic loading of missiles into a missile launcher, can be applied to automatic loading of the other various hazardous entities described above.

Discussion of Possible Embodiments

The following are non-exclusive descriptions of possible embodiments of the present invention.

Some embodiments relate to a system for automatically loading a plurality of hazardous entities into a hazardous-entity container. the system includes an elevator configured to lift a selected hazardous entity of a plurality of hazardous entities from a stowed position to an elevation of a corresponding hazardous-entity portal of the hazardous-entity container. The system includes an alignment sensor configured to sense relative alignment of the selected hazardous entity with respect to the corresponding hazardous-entity portal. The system includes an alignment system configured to align, based on the relative alignment sensed by the alignment sensor, the selected hazardous entity with the corresponding hazardous-entity portal. The system includes an insertion apparatus configured to insert the selected hazardous entity into its corresponding hazardous-entity portal. The system also includes a loading controller configured to evaluate, based at least in part on the relative alignment sensed by the alignment sensor, whether an insertion condition is met. The loading controller if further configured to cause the insertion apparatus to insert the selected hazardous entity into the corresponding hazardous-entity portal in response to the insertion condition being met.

The system of the preceding paragraph can optionally include, additionally and/or alternatively, any one or more of the following features, configurations and/or additional components:

A further embodiment of the foregoing system, wherein the loading controller can be further configured to wait for a time period in response to the insertion condition being not met, and then reevaluates whether the insertion condition is met after the time period has elapsed.

A further embodiment of any of the foregoing systems, wherein the alignment sensor can be further configured to sense a relative axial alignment of the selected hazardous entity with respect to the corresponding hazardous-entity portal.

A further embodiment of any of the foregoing systems, wherein the insertion condition can include an axial alignment condition.

A further embodiment of any of the foregoing systems, wherein the axial alignment condition can be an axial alignment that is less than a 50% of an alignment tolerance of the selected hazardous entity with respect to the corresponding hazardous-entity portal.

A further embodiment of any of the foregoing systems, wherein the alignment sensor can be further configured to sense a rotational alignment of the selected hazardous entity.

A further embodiment of any of the foregoing systems, wherein the insertion condition can include a rotational alignment condition.

A further embodiment of any of the foregoing systems, wherein the alignment sensor can be further configured to sense vibration of the selected hazardous entity.

A further embodiment of any of the foregoing systems, wherein the insertion condition can include a vibration condition of the selected hazardous entity.

A further embodiment of any of the foregoing systems, wherein the alignment sensor can be further configured to sense attitude of the hazardous-entity container.

A further embodiment of any of the foregoing systems, wherein the insertion condition can include an attitude condition of the hazardous-entity container.

A further embodiment of any of the foregoing systems, wherein the attitude condition can be a sensed motion of the hazardous-entity container that is less than a predetermined motion threshold.

A further embodiment of any of the foregoing systems, wherein the attitude condition is a sensed phase condition of a periodic motion of the hazardous-entity container.

A further embodiment of any of the foregoing systems, wherein the loading controller can be further configured to control operation of the system such that each of the plurality of hazardous entities is sequentially loaded into its corresponding hazardous-entity portal of a plurality of hazardous-entity portals.

A further embodiment of any of the foregoing systems, wherein the loading controller can be configured to control operation of the system such that each of the plurality of hazardous entities can be concurrently loaded into its corresponding hazardous-entity portal of a plurality of the hazardous-entity portals.

A further embodiment of any of the foregoing systems can further include a transportation system configured to transport the system to a location adjacent to the hazardous-entity container.

A further embodiment of any of the foregoing systems, wherein, while the selected hazardous entity is inserted into the corresponding hazardous-entity portal, the alignment system can maintain alignment of the selected hazardous entity.

A further embodiment of any of the foregoing systems, wherein, while the selected hazardous entity is inserted into the corresponding hazardous-entity portal, the elevator can maintain support for the selected hazardous entity being inserted.

A further embodiment of any of the foregoing systems, wherein the hazardous entities can be missiles, and the hazardous-entity container is a missile launcher.

Some embodiments relate to a method for automatically loading a plurality of hazardous entities into a hazardous-entity container. In the method a selected hazardous entity of a plurality of hazardous entities is lifted, via an elevator, from a stowed position to an elevation of a corresponding hazardous-entity portal of the hazardous-entity container. Relative alignment of the selected hazardous entity is sensed, via an alignment sensor, with respect to the corresponding hazardous-entity portal. The selected hazardous entity is aligned with the corresponding hazardous-entity portal, via an alignment system, based on the relative alignment sensed by the alignment sensor. An insertion condition is evaluated, via a loading controller, so as to determine whether an insertion condition is met, based at least in part on the relative alignment sensed by the alignment sensor. The selected hazardous entity is inserted, via an insertion apparatus, into its corresponding hazardous-entity portal in response to the insertion condition being met.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system for automatically loading a plurality of hazardous entities into a hazardous-entity container, the system comprising:

an elevator configured to lift a selected hazardous entity of a plurality of hazardous entities from a stowed position to an elevation of a corresponding hazardous-entity portal of the hazardous-entity container;

an alignment sensor configured to sense relative alignment of the selected hazardous entity with respect to the corresponding hazardous-entity portal, wherein the alignment sensor is further configured to sense vibration of the selected hazardous entity;

an alignment system configured to align, based on both the relative alignment and the vibration sensed by the alignment sensor, the selected hazardous entity with the corresponding hazardous-entity portal;

an insertion apparatus configured to insert the selected hazardous entity into its corresponding hazardous-entity portal; and a loading controller configured to evaluate, based at least in part on the relative alignment sensed by the alignment sensor, whether an insertion condition is met, wherein the loading controller is further configured to cause the insertion apparatus to insert the selected hazardous entity into the corresponding hazardous-entity portal in response to the insertion condition being met.

2. The system of claim 1, wherein the loading controller is further configured to wait for a time period in response to the insertion condition being not met, and then reevaluates whether the insertion condition is met after the time period has elapsed.

3. The system of claim 1, wherein the alignment sensor is further configured to sense a relative axial alignment of the selected hazardous entity with respect to the corresponding hazardous-entity portal.

4. The system of claim 3, wherein the insertion condition includes an axial alignment condition.

5. The system of claim 4, wherein the axial alignment condition is an axial alignment that is less than a 50% of an alignment tolerance of the selected hazardous entity with respect to the corresponding hazardous-entity portal.

6. The system of claim 1, wherein the alignment sensor is further configured to sense a rotational alignment of the selected hazardous entity.

7. The system of claim 6, wherein the insertion condition includes a rotational alignment condition.

8. The system of claim 1, wherein the alignment sensor is further configured to sense attitude of the hazardous-entity container.

9. The system of claim 8, wherein the insertion condition includes an attitude condition of the hazardous-entity container.

10. The system of claim 9, wherein the attitude condition is a sensed motion of the hazardous-entity container that is less than a predetermined motion threshold.

11. The system of claim 9, wherein the attitude condition is a sensed phase condition of a periodic motion of the hazardous-entity container.

12. The system of claim 1, wherein the loading controller is further configured to control operation of the system such that each of the plurality of hazardous entities is sequentially loaded into its corresponding hazardous-entity portal of a plurality of hazardous-entity portals.

13. The system of claim 1, wherein the loading controller is configured to control operation of the system such that each of the plurality of hazardous entities can be concurrently loaded into its corresponding hazardous-entity portal of a plurality of the hazardous-entity portals.

14. The system of claim 1, further comprising:

a transportation system configured to transport the system to a location adjacent to the hazardous-entity container.

15. The system of claim 1, wherein, while the selected hazardous entity is inserted into the corresponding hazardous-entity portal, the alignment system maintains alignment of the selected hazardous entity.

16. The system of claim 1, wherein, while the selected hazardous entity is inserted into the corresponding hazardous-entity portal, the elevator maintains support for the selected hazardous entity being inserted.

17. The system of claim 1, wherein the hazardous entities are missiles, and the hazardous-entity container is a missile launcher.

18. A method for automatically loading a plurality of hazardous entities into a hazardous-entity container, the method comprising:

lifting, via an elevator, a selected hazardous entity of a plurality of hazardous entities from a stowed position to an elevation of a corresponding hazardous-entity portal of the hazardous-entity container;

sensing, via an alignment sensor, relative alignment of the selected hazardous entity with respect to the corresponding hazardous-entity portal;

sensing, via the alignment sensor, vibration of the selected hazardous entity;

aligning, via an alignment system, the selected hazardous entity with the corresponding hazardous-entity portal based on the relative alignment sensed by the alignment sensor;

evaluating, via a loading controller, whether an insertion condition is met based at least in part on both the relative alignment and the vibration sensed by the alignment sensor;

inserting, via an insertion apparatus, the selected hazardous entity into its corresponding hazardous-entity portal in response to the insertion condition being met.

* * * * *